United States Patent [19]

Kubo et al.

[11] 4,352,860

[45] Oct. 5, 1982

[54] THERMOSENSITIVE RECORDING MATERIAL

[75] Inventors: Keishi Kubo; Eiichi Kawamura, both of Numazu, Japan

[73] Assignee: Ricoh Company, Ltd., Tokyo, Japan

[21] Appl. No.: 261,558

[22] Filed: May 7, 1981

[30] Foreign Application Priority Data

May 13, 1980 [JP] Japan ..... 55-62312
Jun. 19, 1980 [JP] Japan ..... 55-82167

[51] Int. Cl.[3] ..... B41M 5/18

[52] U.S. Cl. ..... 428/478.2; 282/27.5; 427/150; 427/151; 428/320.8; 428/488; 428/537; 428/913

[58] Field of Search ..... 282/27.5; 427/150, 151, 427/152, 153; 428/320.8, 323, 328–331, 411, 478.2, 478.8, 484, 488, 500, 508, 511, 514, 522, 530–532, 535–537, 913, 914

[56] References Cited

U.S. PATENT DOCUMENTS 3,859,112 1/1975 Kohmura et al. ..... 260/29.3

*Primary Examiner*—Bruce H. Hess
*Attorney, Agent, or Firm*—Oblon, Fisher, Spivak, McClelland & Maier

[57] ABSTRACT

A thermosensitive recording material comprising a support member and a thermosensitive layer formed on the support member, which thermosensitive layer contains a colorless or light-colored leuco dye and acidic material, capable of forming a color upon application of heat to the thermosensitive layer, and at least one amide compound selected from the group consisting of amide compounds represented by the formulas

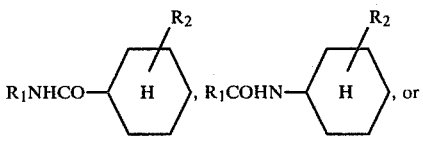

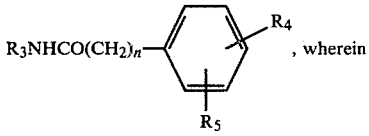

wherein $R_1$ represents an alkyl group with 1 to 30 carbon atoms, a phenyl group or a substituted phenyl group; $R_2$ represents hydrogen or an alkyl group with 1 to 4 carbon atoms; $R_3$ represents an alkyl group with 1 to 30 carbon atoms; $R_4$ and $R_5$ individually represent hydrogen, a halogen atom, an alkyl group with 1 to 4 carbon atoms or an alkoxy group with 1 to 4 carbon atoms; and n is an integer, 0 or 1, whereby image formation is improved with respect to the image density, the quantity of energy required for image formation, and thermal head operation on the thermosensitive recording material, and a compound represented by the formula

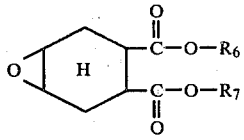

wherein $R_6$ and $R_7$ individually represent an alkyl group with 10 to 30 carbon atoms, whereby prevention of discoloration of the recording material by pressure or friction is achieved.

25 Claims, No Drawings

THERMOSENSITIVE RECORDING MATERIAL

BACKGROUND OF THE INVENTION

The present invention relates to an improved thermosensitive recording material which is capable of forming images with high image density in sharp contrast with the background by application of a relatively small quantity of energy thereto, and therefore which can be employed in highspeed thermosensitive recording apparatus, for example, for use in computers, facsimile apparatus and a variety of measuring instruments.

A thermosensitive recording material is a recording material comprising a support member, for example, paper, and a thermosensitive layer capable of forming a color upon application of heat thereto, which thermosensitive layer is formed on the support member. For the application of heat, for example, a thermal printer with a thermal head is employed.

At present, thermosensitive recording by use of the above-mentioned thermosensitive recording material is done in conjunction with the copying of documents and books and the recording of outputs from computers, facsimile apparatus and various measuring instruments.

For the above-mentioned applications, the thermosensitive recording materials, each comprising (1) a thermosensitive layer containing a colorless or light-colored leuco dye with a lacton ring, a lactam ring or a spiro-pyran ring, and an acidic material, such as an organic acid or a phenolic material, and (2) a support member for supporting the thermosensitive layer thereon, are now used in practice, since, with those thermosensitive recording materials, the developed images are clear and do not deteriorate with time, and those thermosensitive recording materials themselves can be stored for a long period of time without deterioration.

These days, the output speeds of the aforementioned recording apparatus employing the above-mentioned type of thermosensitive recording materials are being remarkably increased, almost day by day, together with the possible information density in the output.

In order to improve the thermosensitivity of thermosensitive recording materials for use in the above-mentioned thermal recording process, for example, the following methods have been proposed: In Japanese Laid-Open Patent Application Serial No. 52-106746, there are disclosed improved thermosensitive recording materials in which acetoacetic anilide compounds are contained for improving the thermosensitivity. In Japanese Laid-Open Patent Application Serial No. 53-48751, there is disclosed a thermosensitive recording material wherein a thermo-fusable material of which the melting point is in the range of 60° C. to 200° C. is contained at least in either the basic dye or the coloring material in the thermosensitive layer of the thermosensitive recording material. Furthermore, in Japanese Patent Application Ser. No. 52-20142, there is disclosed a method of producing a thermosensitive recording material with its development capability improved by treating the surface of its top layer in the range of 200 to 1,000 seconds in terms of Beck Smoothness Degree.

These thermosensitive materials are still not satisfactory for practical use.

As other thermosensitivity improvement agents, the following are known:

Fatty acid amides compounds, such as acetamide, stearic acid amide, linolenic acid amide, lauric acid amide, myristic acid amide, hardened beef fatty acid amide, palmitamide, oleic amide, rice bran fatty acid amide, coconut fatty acid amide, methylol compounds of the above-mentioned fatty acid amides, methylenebis(stearamide), and ethylenebis(stearamide).

When the above-mentioned thermosensitivity improvement agents are employed in the thermosensitive recording materials and thermal recording is performed for a long period of time by a thermal head, those thermosensitivity improvement agents produce dust on the thermal head during the recording process, causing the thermal head to stick to the thermal recording material, hindering its scanning operation along the surface of the thermal recording material and making the developed images unclear. Therefore, it is necessary to clean the thermal head from time to time.

Under such circumstances, a thermal recording process capable of recording images at a high speed continuously for a long period of time, without accumulation of dust on the thermal head during recording the images on a thermosensitive recording material, and therefore without the necessity of cleaning the thermal head, is desired.

Furthermore, the conventional thermosensitive recording materials have additional shortcomings in that fog occurs during storage thereof, and when pressure is applied to the recording materials or when the recording materials are subjected to surface friction, the affected portions of the recording materials are discolored.

SUMMARY OF THE INVENTION

It is therefore an object of the present invention to provide an improved thermosensitive recording material comprising a support member and a thermosensitive layer formed on the support member, which thermosensitive recording material comprises a colorless or light-colored leuco dye and an acidic material, which are capable of forming a color with high density in sharp contrast with the background by application of a relatively small quantity of energy thereto, with increased thermosensitivity.

Another object of the present invention is to provide a thermosensitive recording material of the type described, which does not contribute substantially to the accumulation of dust on a thermal head during an image recording process by use of a thermal printer with a thermal head, attaining smooth thermal recording operation including the scanning of the head for an extended period of time.

A further object of the present invention is to provide a thermosensitive recording material of the type described, in which the discoloring by pressure or friction is prevented, making it possible to obtain clear images with high image density.

A still further object of the present invention is to provide a thermosensitive recording material of the type described, which can be stored for a long period of time, without deterioration including fog during storage.

According to the present invention, in order to attain the above-mentioned objects, at least one of the following materials is contained in the conventional thermosensitive layer:

Compound (1) represented by the formula (1)

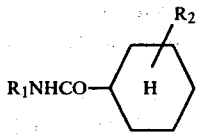

(1)

wherein $R_1$ represents an alkyl group with 1 to 30 carbon atoms, a phenyl group or a substituted phenyl group; and $R_2$ represents hydrogen or an alkyl group with 1 to 4 carbon atoms.

Compound (2) represented by the formula (2)

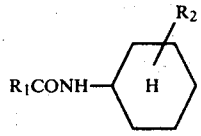

(2)

wherein $R_1$ represents an alkyl group with 1 to 30 carbon atoms, a phenyl group or a substituted phenyl group; and $R_2$ represents hydrogen or an alkyl group with 1 to 4 carbon atoms.

Compound (3) represented by the formula (3)

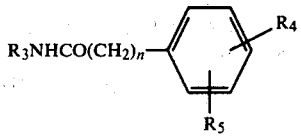

(3)

Wherein $R_3$ represents an alkyl group with 1 to 30 carbon atoms; $R_4$ and $R_5$ individually represent hydrogen, a halogen atom, an alkyl group with 1 to 4 carbon atoms or an alkoxy group with 1 to 4 carbon atoms; and n is an integer, 0 or 1.

Alternatively, in addition to one of the above-mentioned compounds, Compound (4) represented by the formula (4)

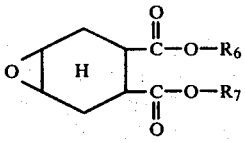

(4)

wherein $R_6$ and $R_7$ individual represent an alkyl group with 10 to 30 carbon atoms, is contained in the thermosensitive layer.

DETAILED DESCRIPTION OF THE PREFERRED EMBODIMENTS

A thermosensitive recording material according to the present invention comprises a support member, and a thermosensitive layer formed on the support member, which thermosensitive layer contains a colorless or light-colored leuco dye, an acidic material capable of coloring the leuco dye upon application of heat thereto, and at least one compound which belongs to one of the following Compounds (1) to (3), which are respectively represented by general formulas (1) to (3), or in addition to the compounds, a Compound (4) represented by the formula (4) in contained in the thermosensitive layer.

I. Compound (1) represented by the formula (1)

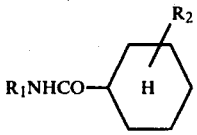

(1)

wherein $R_1$ represents an alkyl group with 1 to 30 carbon atoms, a phenyl group or a substituted phenyl group; and $R_2$ represents hydrogen or an alkyl group with 1 to 4 carbon atoms.

An example of Compound (1) is N-stearyl-hexahydrobenzamide

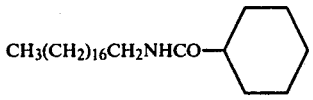

(1)-1

II. Compound (2) represented by the formula (2)

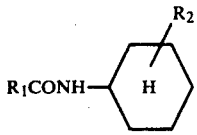

(2)

wherein $R_1$ represents an alkyl group with 1 to 30 carbon atoms, a phenyl group or a substituted phenyl group; and $R_2$ represents hydrogen or an alkyl group with 1 to 4 carbon atoms.

Examples of Compound (2) are as follows:

N-cyclohexylacetamide

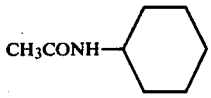

(2)-1

N-cyclohexylpropionamide

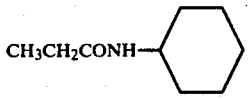

(2)-2

N-cyclohexylstearamide

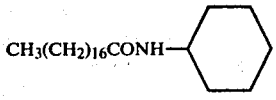

(2)-3

N-cyclohexylbenzamide

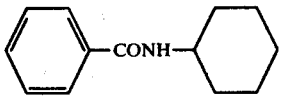

(2)-4

N-cyclohexyl-2-methylbenzamide

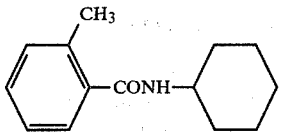

(2)-5

N-cyclohexyl-2-chlorobenzamide

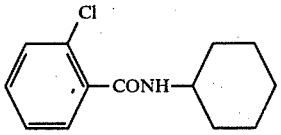

(2)-6

N-cyclohexyl-2,4-dimethylbenzamide

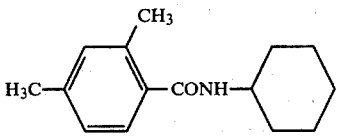

(2)-7

N-cyclohexylpalmitamide

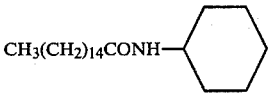

(2)-8

N-(2-chlorocyclohexyl) palmitamide

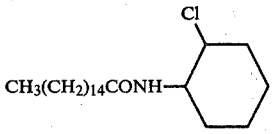

(2)-9

N-(2-methylcyclohexyl) stearamide

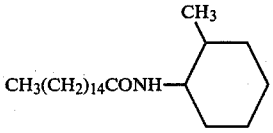

(2)-10

III. Compound (3) represented by the formula (3)

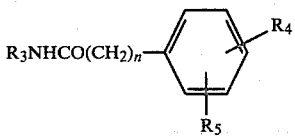

(3)

wherein $R_3$ represents an alkyl group with 1 to 30 carbon atoms; $R_4$ and $R_5$ individually represent hydrogen, a halogen atom, an alkyl group with 1 to 4 carbon atoms or an alkoxy group with 1 to 4 carbon atoms; and n is interger, 0 or 1.

Examples of Compound (3) are as follows:

N-stearylbenzamide

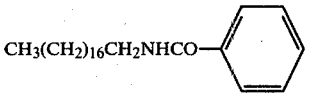

(3)-1

N-palmityl-2-chlorobenzamide

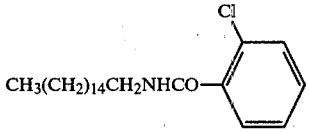

(3)-2

N-stearyl-2-methoxybenzamide

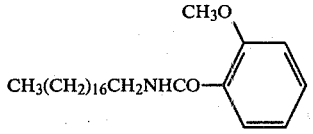

(3)-3

N-stearyl-2-methylbenzamide

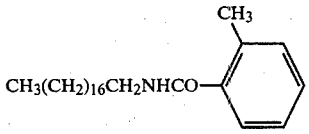

(3)-4

N-stearyl-4-methylbenzamide

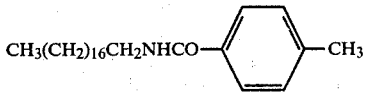

(3)-5

N-palmityl-2,4-dimethylbenzamide

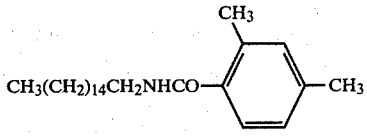

(3)-6

N-behenylbenzamide

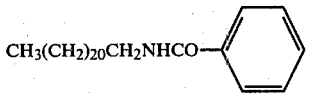

(3)-7

N-behenyl-2-methylbenzamide

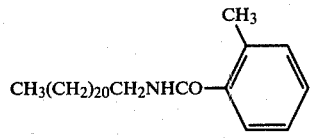

(3)-8

N-stearylphenylacetamide (3)-9

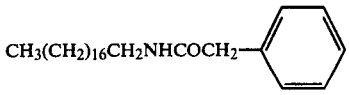

N-behenylphenylacetamide (3)-10

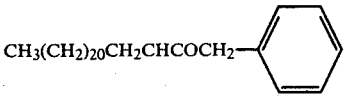

IV. Compound (4) represented by the formula (4)

(4)

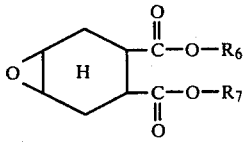

wherein $R_6$ and $R_7$ individually represent an alkyl group with 10 to 30 carbon atoms.

In particular, it is preferable that $R_6$ and $R_7$ in Compounds (4) each be an alkyl group with 16 to 22 carbon atoms, more specifically, hexadecyl, heptadecyl, octadecyl, nonadecyl, eicosyl, heneicosyl or docosyl.

Synthesis of examples of Compounds (1) to (3) will now be described. Synthesis of N-stearyl-hexahydrobenzamide (Compound (1)-1)

27 g of stearylamine was dissolved in 100 ml of benzene at 30° C. To the resulting solution was very slowly added 20 g of hexahydrobenzoic acid chloride with stirring, keeping the temperature in the range of 0° C. to 10° C. The addition required one hour. The temperature of the mixture was then raised to 60° C. and the mixture was stirred at that temperature for 3 hours. The mixture was then cooled. White crystals were separated from the mixture. The crystals were filtered off, neutralized with alkaline alcohol, and washed with water. The material so obtained was recrystallized from ethanol, from which it separated as white crystals melting at 89° C. to 90° C. The yield was 83%.

Synthesis of N-cyclohexylstearamide (Compound (2)-3)

10 g of cyclohexylamine was dissolved in 80 ml of toluene. The resulting solution was cooled below 20° C. and 30 g of stearic acid chloride was added to the solution with stirring at temperatures below 20° C. The addition required one hour. The mixture solidified entirely. The solidified mixture was maintained at 30° C. for 2 hours. White crystals contained in the mixture was then filtered off, neutralized with alkaline alcohol and washed with water. The material so obtained was recrystallized from alcohol, from which it separated as white needles melting at 93.5° C. to 94.5° C. The yeild was 86%.

Synthesis of N-cyclohexylbenzamide (Compound (2)-4)

18 g of cyclohexylamine was dissolved in 150 ml of benzene. To the resulting solution was very slowly added 20 g of benzoyl chloride with stirring at temperatures below 40° C. White crystals separated from the mixture, generating white smoke. The mixture was stirred for one hour and was then made alkaline by addition of pyridine thereto. The product was filtered with suction. Crude crystals melting at 142° C. to 144° C. were recrystallized from a mixture of methanol and ethanol (1:1 in volume), from which white needles melting at 144° C. to 145° C. separated. The yield was 84%.

Synthesis of N-stearylbenzamide (Compound (3)-1)

27 g of stearylamine was dispersed in 100 ml of toluene. To this dispersion was added 13 g of benzoyl chloride at 70° C. An exothermic reaction occurred and the temperature of the mixture increased to 80° C. The reaction mixture was heated to 100° C. and that temperature was maintained for about 20 hours until generation of hydrogen chloride gas was terminated. The reaction mixture was cooled, from which white crude crystals were separated. The thus obtained white crystals were neutralized with sodium hydroxide and were then recrystallized from alcohol. This recrystallization gave white crystals melting at 85° C. to 87° C. The yield was 83%.

Synthesis of N-stearylphenylacetylamide (Compound (3)-9)

27 g of stearylamine was dispersed in 100 ml of toluene. To this dispersion was very slowly added 14 g of phenylacetic acid chloride at 70° C. The temperature of the reaction mixture was elevated to 90° C. and the mixture was allowed to react at that temperature for 10 hours. The reaction mixture was cooled, from which white crude crystals were separated. The thus obtained white crystals were filtered off, neutralized with sodium hydroxide and were then recrystallized from alcohol. This recrystallization gave white crystals melting at 93° C. to 94° C. The yield was 86%.

Examples of leuco dyes that can be employed in the present invention are as follows:

(1) Leuco bases of triphenylmethane dyes represented by the following general formula:

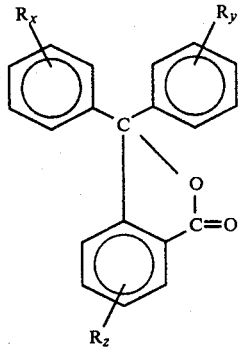

wherein $R_x$, $R_y$ and $R_z$ are individually hydrogen, a hydroxyl group, a halogen, an alkyl group, a nitro group, an amino group, a dialkylamino group, a monoalkylamino group, or an aryl group.

Specific examples of the above-mentioned compounds are as follows:

3,3-bis(p-dimethylaminophenyl)-phthalide,
3,3-bis(p-dimethylaminophenyl)-6-dimethylaminophthalide (of Crystal Violet Lacton),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide.

(2) Leuco bases of fluoran dyes represented by the following general formula:

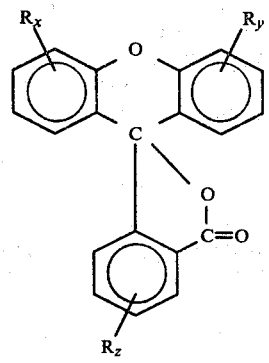

wherein, $R_x$, $R_y$ and $R_z$ are individually hydrogen, a hydroxyl group, a halogen, an alkyl group, a nitro group, an amino group, a dialkylamino group, a monoalkylamino group or an aryl group.

Specific examples of the above-mentioned compounds are as follows:

3-cyclohexylamino-6-chlorofluoran,
3-(N-N-diethylamino)-5-methyl-7-(N,N-dibenzylamino) fluoran,
3-dimethylamino-5,7-dimethylfluoran,
3-diethylamino-7-methylfluoran, (3) Fluoran dyes:

3-diethylamino-6-methyl-7-chlorofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino) exanthylbenzoic acid lactam]

(4) Lactone compounds represented by the following general formula:

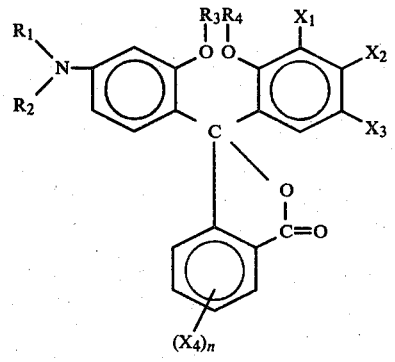

wherein $R_1$ and $R_2$ individually represent hydrogen, a lower alkyl group, a substituted or unsubstituted alkyl group, a substituted or unsubstituted phenyl group, a cyanoethyl group, a $\beta$-halogenated ethyl group, or $R_1$ and $R_2$ in combination represent $-(CH_2)_4-$, $-(CH_2)_5-$ or $-(CH_2)_2O(CH_2)_2-$, and at least one of $R_3$ and $R_4$ is hydrogen and the other is hydrogen, a lower alkyl group, an aralkyl group, an amyl group or a penyl group, and $X_1$, $X_2$ and $X_3$ individually represent hydrogen, a lower alkyl group, a lower alkoxy group, a halogen, a halogenated methyl group, a nitro group, an amino group or a substituted amino group, and $X_4$ represents hydrogen, a halogen, a lower alkyl group or a lower alkoxyl group, and n is an interger, 0 or 1 to 4.

Specific examples of the above-mentioned compounds are as follows:

3-(2'-hydroxy-4'-dimethylaminophenyl)-3-(2'-methoxy-5'-chlorophenyl) pathalide,
3-(2'-hydroxy-4'-dimethylaminophenyl)-3-(2'-methoxy-5'-nitrophenyl pathalide,
3-(2'-hydroxy-4'-diethylaminophenyl)-3-(2'-methoxy-5'-methylphenyl) phthalide,
3-(2'-methoxy-4'-dimethylaminophenyl)-3-(2'-hydroxy-4'-chloro-5'-methylphenyl) phthalide.

Examples of acidic materials that can be employed in the present invention are as follows:

Boric acid, oxalic acid, maleic acid, tartaric acid, citric acid, succinic acid, benzoic acid, steric acid, gallic acid, salicylic acid, 1-hydroxy-2-naphthoic acid, o-hydroxybenzoic acid, m-hydroxybenzoic acid, 2-hydroxy-p-toluic acid, 3,5-xylenol, thymol, p-tert-butylphenol, 4-hydroxyphenoxide, methyl-4-hydroxybenzoate, 4-hydroxyacetophenone, $\alpha$-naphthol, $\beta$-naphthol, catechol, resorcin, hydroquinone, 4-tert-octylcatechol, 4,4'-sec-butylidenephenol, 2,2'-dihydroxydiphenyl, 2,2'-methylenebis(4-methyl-6-tert-butylphenol), 2,2'-bis(4'-hydroxyphenyl)propane (or bisphenol A), 4,4'-isopropylidenebis(2-tert-butylphenol), 4,4'-sec-butylidenediphenol, pyrogallol, phloroglucine, phlorogluocinocarboxylic acid.

In the thermosensitive layer of a thermosensitive recording material according to the present invention, the following binder agents can be employed:

Water-soluble organic polymers, such as polyvinyl alcohol, methoxycellulose, hydroxyethylcellulose, carboxymethylcellulose, polyvinylpyrrolidone, polyacrylamide, polyacrylic acid, starch, gelatin; and water emulsions of polystyrene, copolymer of vinyl chloride and vinyl acetate, and polybutylmethacrylate.

Furthermore, in the thermosensitive layer, the following additives can be contained in the form of fine powder to obtain clear images:

Calcium carbonate, silica, alumina, magnesia, talc, barium sulfate and aluminum stearate.

Moreover, in order to improve the running of a thermal head along the thermosensitive recording material according to the present invention, the following lubricating materials can be added to the thermosensitive layer:

Linseed oil, tung oil, wax, paraffin, polyethylene wax, and chlorinated paraffin.

As mentioned previously, Compounds (1) to (3) serve to improve the thermosensitivity of a thermosensitive recording material. This is because the quantity of heat-required for fusing each of the compounds (hereinafter referred to the heat of fusion) is rather small and, furthermore, those compounds serve to lower the melting points of the leuco dye and the acidic material contained in the thermosensitive layer. Therefore, the leuco dye and the acidic material melt at relatively low temperatures and, accordingly, the color formation can be done with a comparatively small amount of energy. In other words, Compounds (1) to (3) serve to increase the coloring speed of the thermosensitive recording material. Further, those compounds prevent deterioration of the thermosensitive recording material.

Furthermore, of Compounds (1) to (3), those having a comparatively long-chain alkyl group are capable of making the surface of the thermosensitive recording material smooth, attaining easy and smooth sliding of the thermal head along the surface of the thermosensitive recording material, thus improving the recording performance of the thermosensitive recording material. Moreover, since the smoothness of the surface of the thermosensitive recording material is improved by Compounds (1) to (3), dust is hardly formed during the recording process by the thermal head and, therefore, the recording duration can be significantly extended in comparison with the recording duration in the case of the conventional thermosensitive recording material.

As mentioned previously, in a thermosensitive recording material according to the present invention, at least one of Compounds (1) to (3) is contained in the thermosensitive layer of the recording material. It is preferable that the amount of Compounds (1), (2) or (3), or of the combination thereof, to be added to the thermosensitive layer be in total 0.05 to 4.0 parts by weight with respect to one part by weight of a leuco dye. When the total amount of the added Compounds is less than 0.05 part by weight, the thermosensitivity and recording characteristics of the thermosensitive recording material tend not to be adequately improved, and when the total amount of the Compounds is greater than 4.0 parts by weight, the thermosensitivity and recording characteristics cannot be improved any further.

In combination with the above-mentioned Compounds (1) to (3), Compounds (4) can be employed to further improve the thermosensitivity and recording characteristics of the thermosensitive recording material according to the present invention.

The Compounds (4) particularly serve to improve the smoothness of the surface of the thermosensitive layer, attaining easy and smooth sliding of the thermal head along the surface of the thermosensitive layer, thus reducing the formation of dust around the thermal head and preventing the thermal head from sticking to the surface of the thermosensitive layer.

Furthermore, the Compounds (4) are capable of preventing discoloring of portions of the thermosensitive recording material subjected to pressure or friction.

In particular, when the Compounds (4) and the Compounds (1) to (3) are used in combination, the advantages obtained by each Compound overlap.

In short, (i) thermosensitive recording can be done by a relatively small quantity of energy, (ii) discoloring of the thermosensitive recording material by pressure application or friction can be prevented, (iii) the formation of dust during the recording using the thermal head can be prevented and easy and smooth recording operation can be attained, (iv) the thermosensitive recording paper can be stored for a long period of time, without deterioration.

When the Compounds (4) and the Compounds (1) to (3) are used in combination, the total amount of the Compounds (1) to (3) is preferably in the range of 0.5 to 5 parts by weight with respect to one part by weight of the leuco dye contained in the thermosensitive layer. The Compounds (1) to (3) can be used individually or in combination. When the total amount of the Compounds (1) to (3) is less than 0.5 part by weight, the thermosensitivity and recording characteristics of the thermosensitive recording material cannot be adequately improved. On the other hand, when the total amount of the Compounds (1) to (3) is more than 5 parts by weight, the thermosensitivity and recording characteristics cannot be improved any further.

The Compounds (4) can also be used individually or in combination. The total amount of the Compounds (4) is preferably in the range of 0.2 to 3 parts by weight with respect to one part by weight of the total amount of the Compounds (1) to (3). When the total amount of the Compounds (4) is less than 0.2 part by weight, the recording characteristics cannot be improved adequately, while when the total amount of the same is greater than 3 parts by weight, the recording characteristics cannot be improved any further.

Embodiments of a thermosensitive recording material according to the present invention will now be described.

EXAMPLE 1

A dispersant A and a dispersant B were prepared by mixing the following components of each dispersant in a ball mill for 10 hours.

| | Parts by Weight |
|---|---|
| Dispersant A | |
| 3-pyrrolidino-6-methyl-7-anilinofluoran | 5.7 |
| Polyvinyl alcohol (10% aqueous solution) | 25.0 |
| Water | 19.8 |
| Dispersant B | |
| Bisphenol A | 21.0 |
| Hydroxyethylcellulose | 2.7 |
| N—cyclohexylstearamide | 8.0 |
| Water | 18.3 |

The thus prepared dispersant A and dispersant B were mixed to prepare a thermosensitive coloring liquid for forming a thermosensitive layer. This thermosensitive coloring liquid was coated on the surface of a sheet of high quality paper (50 g/m$^2$) by a wire bar and then dried, whereby a thermosensitive layer was formed thereon. The deposition of the thermosensitive layer on the sheet was 5.6 g/m$^2$.

By use of the thus prepared thermosensitive recording material, thermal printing was performed by a thermal printer with a thermal head which was heated to 110° C. As a result, a clear image was formed on the thermosensitive recording material.

The energy required for obtaining by the thermal head an image with an image density of 0.8 measured by a Macbeth reflection-type densitometer was 1.03 mJ, when a potential of 14 voltages was applied to the thermal head.

Furthermore, the thermosensitive recording material was employed in a commercially available facsimile apparatus continuously for 24 hours in order to check the running performance of the thermal head of the facsimile apparatus on the thermosensitive recording material. The result was that no dust was observed on the thermal head after that long operation and equally clear images were obtained at the end of that test.

EXAMPLE 2

A thermosensitive recording material was prepared replacing only N-cyclohexylstearamide in dispersant B of Example 1 with N-cyclohexylbenzamide, with the other conditions being exactly the same as those in Example 1.

Image formation was performed in the same manner as in Example 1 by the thermal head and equally clear images were obtained.

The energy required for obtaining an image with an image density of 0.8 by the thermal head was 1.05 mJ.

Furthermore, no dust was accumulated on the thermal head when the thermosensitive recording material was used in the facsimile apparatus under the same conditions as those in Example 1.

EXAMPLES 3 TO 7

In Examples 3 to 7, the respective thermosensitive recording materials were prepared by replacing only N-cyclohexylstearamide in dispersant B of Example 1 with the following compounds:

N-stearyl-hexahydrobenzamide in Example 3
N-stearylbenzamide in Example 4
N-stearylphenylacetylamide in Example 5
N-cyclohexylacetamide in Example 6
N-behenylbenzamide in Example 7.

The thermosensitive recording materials of Examples 3 to 7 were as excellent in thermosensitivity and recording characteristics as those of Examples 1 and 2.

The energy required for obtaining by the thermal head an image with an image density of 0.8 with respect to each of the thermosensitive recording materials was as follows:

Thermosensitive recording material in Example 3: 1.04 mJ
Thermosensitive recording material in Example 4: 1.02 mJ
Thermosensitive recording material in Example 5: 1.06 mJ
Thermosensitive recording material in Example 6: 1.04 mJ
Thermosensitive recording material in Example 7: 1.07 mJ In the following embodiments of a thermosensitive recording material according to the present invention, the aforementioned Compounds (4) are employed in combination with Compounds (1) to (3).

EXAMPLE 8

A dispersant A-8 and a dispersant B-8 were prepared by mixing the following components of each dispersant in a ball mill for 10 hours.

| | Parts by Weight |
|---|---|
| Dispersant A-8 | |
| 2[N—(3'-trifluoromethylphenyl)amino]-6-diethylaminofluoran | 6.2 |
| Polyvinyl alcohol (10% aqueous solution) | 23.0 |
| Water | 20.8 |
| Dispersant B-8 | |
| Bisphenol A | 23.0 |
| Oxidized starch | 3.0 |
| Aluminum stearate | 2.0 |
| N—stearylphenylacetamide | 8.6 |
| Distearyl-4,5-epoxycyclohexene-1,2-dicarboxylate | 4.3 |
| Water | 9.1 |

The thus prepared dispersant A-8 and dispersant B-8 were mixed to prepare a thermosensitive coloring liquid for forming a thermosensitive layer. This thermosensitive coloring liquid was coated on the surface of a sheet of high quality paper (50 g/m$^2$) by a wire bar and then dried, whereby a thermosensitive layer was formed thereon. The deposition of the thermosensitive layer on the sheet was 5.8 g/m$^2$.

By use of the thus prepared thermosensitive recording material, thermal printing was performed by a thermal printer with a thermal head which was heated to 120° C. As a result, a clear black image was formed on the thermosensitive recording material.

Furthermore, the thermosensitive recording material was employed in a commercially available facsimile apparatus continuously for 24 hours in order to check the running performance of the thermal head of the facsimile apparatus on the thermosensitive recording material. The result was that no dust was observed on the thermal head after that long operation and no sticking of the thermal head to the thermosensitive layer took place and equally clear images were obtained at the end of that test.

Coloring of the non-image areas, which may be caused by application of pressure thereto or friction thereagainst, was not observed at all.

Furthermore, the thermosensitive recording material was allowed to stand at 60° C. for 24 hours. No fog occurred in the thermosensitive recording material, indicating that it can be stored without deterioration for a long period of time.

EXAMPLE 9

A dispersant A-9 and a dispersant B-9 were prepared by mixing the following components of each dispersant in a ball mill for 10 hours.

| | Parts by Weight |
|---|---|
| Dispersant A-9 | |
| 2[N—(3'-trifluoromethylphenyl)amino]-6-diethylaminofluoran | 6.2 |
| Polyvinyl alcohol (10% aqueous solution) | 23.0 |
| Water | 20.8 |
| Dispersant B-9 | |
| Bisphenol A | 23.0 |
| Oxidized starch | 3.0 |
| Aluminum stearate | 2.0 |
| N—cyclohexylstearamide | 8.6 |
| Dibehenyl-4,5-epoxycyclohexene-1,2-dicarboxylate | 4.3 |
| Water | 9.1 |

A thermosensitive recording material was prepared in the same manner as in Example 9 by use of the above-mentioned dispersants A-9 and B-9.

By use of the thermosensitive recording material, thermal printing was performed by a thermal printer in the same manner as in Example 8. As a result, a clear black image was formed on the thermosensitive recording material.

Furthermore, the thermosensitive recording material was employed in a commercially available facsimile apparatus continuously for 24 hours in order to check the running performance of the thermal head of the facsimile apparatus on the thermosensitive recording material. The result was that no dust was observed on the thermal head after that long operation and no sticking of the thermal head to the thermosensitive layer took place and equally clear images were obtained at the end of that test.

Coloring of the non-image areas, which may be caused by application of pressure thereto or friction thereagainst, was not observed at all.

Furthermore, the thermosensitive recording material was allowed to stand at 60° C. for 24 hours. No fog occurred in the thermosensitive recording material, indicating that it can be stored without deterioration for a long period of time.

EXAMPLE 10

A dispersant A-10 and a dispersant B-10 were prepared by mixing the following components of each dispersant in a ball mill for 10 hours.

| | Parts by Weight |
|---|---|
| Dispersant A-10 | |
| 2[N—(3'-trifluoromethylphenyl)amino]-6-diethylaminofluoran | 6.2 |
| Polyvinyl alcohol (10% aqueous solution) | 23.0 |
| Water | 20.8 |
| Dispersant B-10 | |
| Bisphenol A | 23.0 |
| Oxidized starch | 3.0 |
| Aluminum stearate | 2.0 |
| N—stearylbenzamide | 8.6 |
| Distearyl-4,5-epoxycyclohexene-1,2-dicarboxylate | 4.3 |
| Water | 9.1 |

The thus prepared dispersant A-10 and dispersant B-10 were mixed to prepare a thermosensitive coloring liquid for forming a thermosensitive layer. This thermosensitive coloring liquid was coated on the surface of a sheet of high quality paper (50 g/m$^2$) by a wire bar and then dried, whereby a thermosensitive layer was formed thereon. The deposition of the thermosensitive layer on the sheet was 5.8 g/m$^2$.

By use of the thus prepared thermosensitive recording material, thermal printing was performed by a thermal printer with a thermal head which was heated to 120° C. As a result, a clear image was formed on the thermosensitive recording material.

Furthermore, the thermosensitive recording material was employed in a commercially available facsimile apparatus continuously for 24 hours in order to check the running performance of the thermal head of the facsimile apparatus on the thermosensitive recording material. The result was that no dust was observed on the thermal head after that long operation and no sticking of the thermal head to the thermosensitive layer took place and equally clear images were obtained at the end of that test.

Coloring of the non-image areas, which may be caused by application of pressure thereto or friction thereagainst, was not observed at all.

Furthermore, the thermosensitive recording material was allowed to stand at 60° C. for 24 hours. No fog occurred in the thermosensitive recording material, indicating that it can be stored without deterioration for a long period of time.

EXAMPLES 11 TO 14

In Examples 11 to 14, the respective thermosensitive recording materials were prepared by replacing only N-stearylphenylacetamide in dispersant B-10 of Example 10 with the following compounds:

N-stearyl-2-methoxybenzamide in Example 11
N-behenyl-2-methylbenzamide in Example 12
N-cyclohexylbenzamide in Example 13
N-stearylhexahydrobenzamide in Example 14

The thermosensitive recording materials of Examples 11 to 14 were as excellent in thermosensitivity and recording characteristics as those of Examples 8 to 10.

The above-mentioned embodiments of a thermosensitive recording material according to the present invention are intended to be merely exemplary and those skilled in the art will be able to make variations and modifications in the without departing from the spirit and scope of the invention. For instance, the thermosensitive layer can be placed on a plastic film or any other material by using an adhesive agent, and a colorless or transparent protective layer, for instance, made of an organic polymer, can be formed on the thermosensitive layer. Furthermore, by use of a self-crosslinking polymeric material as a binder agent in the thermosensitive layer, a thermosensitive recording material without any support member can be made.

What is claimed is:

1. A thermosensitive recording material comprising a support member and a thermosensitive layer formed on said support member, said thermosensitive layer comprising a leuco dye and an acidic material capable of forming a color upon application of heat thereto, and at least one amide compound selected from the group consisting of an amide compound (1) represented by the formula (1)

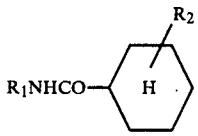

(1)

wherein $R_1$ represents an alkyl group with 1 to 30 carbon atoms, a phenyl group or a substituted phenyl group; and $R_2$ represents hydrogen or an alkyl group with 1 to 4 carbon atoms;

an amide compound (2) represented by the formula (2)

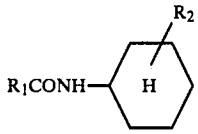

(2)

wherein $R_1$ represents an alkyl group with 1 to 30 carbon atoms, a phenyl group or a substituted phenyl group, and $R_2$ represents hydrogen or an alkyl group with 1 to 4 carbon atoms; and an amide compound (3) represented by the formula (3)

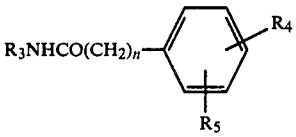

(3)

wherein $R_3$ represents an alkyl group with 1 to 30 carbon atoms; $R_4$ and $R_5$ individually represent hydrogen, a halogen atom, an alkyl group with 1 to 4 carbon atoms or an alkoxy group with 1 to 4 carbon atoms; and n is an integer, 0 or 1.

2. A thermosensitive recording material as claimed in claim 1, wherein the total amount of said amide compounds contained in said thermosensitive layer is in the range of 0.05 to 4.0 parts by weight with respect to one part by weight of said leuco dye.

3. A thermosensitive recording material as claimed in claim 1, wherein said amide compound (1) is N-stearylhexahydrobenzamide.

4. A thermosensitive recording material as claimed in claim 1, wherein said amide compound (2) is a compound selected from the group consisting of:

N-cyclohexylacetamide
N-cyclohexylpropionamide

N-cyclohexylstearamide
N-cyclohexylbenzamide
N-cyclohexyl-2-methylbenzamide
N-cyclohexyl-2-chlorobenzamide
N-cyclohexyl-2,4-dimethylbenzamide
N-cyclohexylpalmitamide
N-(2-chlorocyclohexyl) palmitamide
N-(2-methylcyclohexyl) stearamide

5. A thermosensitive recording material as claimed in claim 1, wherein said amide compound (3) is a compound selected from the group consisting of:
N-stearylbenzamide
N-palmityl-2-chlorobenzamide
N-stearyl-2-methoxybenzamide
N-stearyl-2-methylbenzamide
N-stearyl-4-methylbenzamide
N-palmityl-2,4-dimethylbenzamide
N-behenylbenzamide
N-behenyl-2-methylbenzamide
N-stearylphenylacetamide
N-behenylphenylacetamide

6. A thermosensitive recording material as claimed in claim 1, wherein said leuco dye is a colorless or light-colored dye compound selected from triphenylmethane dyes, fluoran dyes and lactone compounds.

7. A thermosensitive recording material as claimed in claim 1, wherein said acidic material is an organic acid which is selected from the group consisting of boric acid, oxalic acid, maleic acid, tartaric acid, citric acid, succinic acid, benzoic acid, steric acid, gallic acid, salicylic acid, 1-hydroxy-2-naphthoic acid, o-hydroxybenzoic acid, m-hydroxybenzoic acid and 2-hydroxy-p-toluic acid.

8. A thermosensitive recording material as claimed in claim 1, wherein said acidic material is a phenolic material which is selected from the group consisting of 3,5-xylenol, thymol, p-tert-butylphenyl, 4-hydroxyphenoxide, methyl-4-hydroxybenzoate, 4-hydroxyacetophenone, α-naphthol, β-naphthol, catechol, resorcin, hydroquinone, 4-tert-octylcatechol, 4,4'-sec-butylidenephenol, 2,2'-dihydroxydiphenyl, 2,2'-methylenebis(4-methyl-6-tert-butylphenol), 2,2'-bis(4'-hydroxyphenyl)-propane (or bisphenol A), 4,4'-isopropylidenebis(2-tert-butylphenol), 4,4'-sec-butylidenediphenol, phyrogallol, phloroglucine and phlorogluocinocarboxylic acid.

9. A thermosensitive recording material as claimed in claim 1, wherein said thermosensitive layer further comprises a binder agent selected from the group consisting of water-soluble organic polymers and water emulsions of polystyrene, copolymer of vinyl chloride and vinyl acetate, or polybutylmethacrylate.

10. A thermosensitive recording material as claimed in claim 1, wherein said thermosensitive layer further comprises an additive for improvement of image quality, which additive is selected from the group consisting of calcium carbonate, silica, alumina, magnesia, talc, barium sulfate, and aluminum stearate.

11. A thermosensitive recording material as claimed in claim 1, wherein said thermosensitive layer further comprises a lubricating additive which is selected from the group consisting of linseed oil, tung oil, wax, paraffin, polyethylene wax, and chlorinated paraffin.

12. A thermosensitive recording material comprising a support member and a thermosensitive layer formed on said support member, said thermosensitive layer comprising a leuco dye and an acidic material, capable of forming a color upon application of heat thereto, a dicarboxylate compound represented by the formula

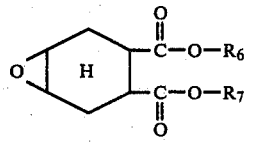

wherein $R_6$ and $R_7$ individually represent an alkyl group with 10 to 30 carbon atoms, and at least one amide selected from the group consisting of:

an amide compound (1) represented by the formula (1)

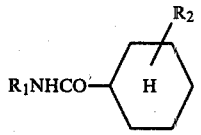

(1)

wherein $R_1$ represents an alkyl group with 1 to 30 carbon atoms, a phenyl group or a substituted phenyl group; and $R_2$ represents hydrogen or an alkyl group with 1 to 4 carbon atoms;

an amide compound (2) represented by the formula (2)

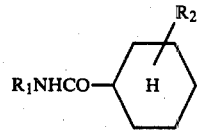

(2)

wherein $R_1$ represents an alkyl group with 1 to 30 carbon atoms, a phenyl group or substituted phenyl group; and $R_2$ represents hydrogen or an alkyl group with 1 to 4 carbon atoms; and an amide compound (3) represented by the formula (3)

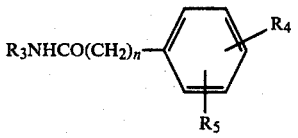

(3)

wherein $R_3$ represents an alkyl group with 1 to 30 carbon atoms; $R_4$ and $R_5$ individually represent hydrogen, a halogen atom, an alkyl group with 1 to 4 carbon atoms or an alkoxy group with 1 to 4 carbon atoms; and n is an integer, 0 to 1.

13. A thermosensitive recording material as claimed in claim 12, wherein the total amount of said amide compounds contained in said thermosensitive layer is in the range of 0.5 to 5 parts by weight with respect to one part by weight of said leuco dye, and the total amount of said dicarboxylate compound is in the range of 0.2 to 3 parts by weight with respect to one part by weight of the total amount of said amide compounds.

14. A thermosensitive recording material as claimed in claim 12, wherein said dicarboxylate compound is a compound selected from the group consisting of distearyl-4,5-epoxycyclohexene-1,2-dicarboxylate, and dibehenyl-4,5-epoxycyclohexene-1,2-dicarboxylate.

15. A thermosensitive recording material as claimed in claim 12, wherein said amide compound (1) is N-stearylhexahydrobenzamide.

16. A thermosensitive recording material as claimed in claim 12, wherein said amide compound (2) is a compound selected from the group consisting of:
N-cyclohexylacetamide
N-cyclohexylpropionamide
N-cyclohexylstearamide
N-cyclohexylbenzamide
N-cyclohexyl-2-methylbenzamide
N-cyclohexyl-2-chlorobenzamide
N-cyclohexyl-2,4-dimethylbenzamide
N-cyclohexylpalmitamide
N-(2-chlorocyclohexyl) palmitamide
N-(2-methylcyclohexyl) stearamide 17. A thermosensitive recording material as claimed in claim 12, wherein said amide compound (3) is a compound selected from the group consisting of
N-stearylbenzamide
N-palmityl-2-chlorobenzamide
N-stearyl-2-methoxybenzamide
N-stearyl-2-methylbenzamide
N-stearyl-4-methylbenzamide
N-palmityl-2,4-dimethylbenzamide
N-behenylbenzamide
N-behenyl-2-methylbenzamide
N-stearylphenylacetamide
N-behenylphenylacetamide 18. A thermosensitive recording material as claimed in claim 12, wherein said leuco dye is a colorless or light-colored dye compound selected from triphenylmethane dyes, fluoran dyes and lactone compounds.

19. A thermosensitive recording material as claimed in claim 12, wherein said acidic material is an organic acid which is selected from the group consisting of boric acid, oxalic acid, maleic acid, tartaric acid, citric acid, succinic acid, benzoic acid, steric acid, gallic acid, salicylic acid, 1-hydroxy-2-naphthoic acid, o-hydroxybenzoic acid, m-hydroxybenzoic acid and 2-hydroxy-p-toluic acid.

20. A thermosensitive recording material as claimed in claim 12, wherein said acidic material is a phenolic material which is selected from the group consisting of 3,5-xylenol, thymol, p-tert-butylphenol, 4-hydroxyphenoxide, methyl-4-hydroxybenzonate, 4-hydroxyacetophenone, α-naphthol, β-naphthol, catechol, resorcin, hydroquinone, 4-tert-octylcatechol, 4,4'-sec-butylidenephenol, 2,2'-dihydroxydiphenyl, 2,2'-methylenebis(4-methyl-6-tert-butylphenol), 2,2'-bis(4'-hydroxyphenyl)propane (or bisphenol A), 4,4'-isopropylidenebis(2-tert-butylphenol), 4,4'-sec-butylidenediphenol, pyrogallol, phloroglucine and phlorogluocinocarboxylic acid.

21. A thermosensitive recording material as claimed in claim 12, wherein said thermosensitive layer further comprises a binder agent selected from the group consisting of water-soluble organic polymers and water emulsions of polystyrene, copolymer of vinyl chloride and vinyl acetate, or polybutylmethacrylate.

22. A thermosensitive recording material as claimed in claim 12, wherein said thermosensitive layer further comprises an additive for improvement of image quality, which additive is selected from the group consisting of calcium carbonate, silica, alumina, magnesia, talc, barium sulfate, and aluminum stearate.

23. A thermosensitive recording material as claimed in claim 12, wherein said thermosensitive layer further comprises a lubricating additive which is selected from the group consisting of linseed oil, tung oil, wax, paraffin, polyethylene wax, and chlorinated paraffin.

24. A thermosensitive recording material as claimed in claim 9, wherein the water-soluble organic polymers are selected from the group consisting of polyvinyl alcohol, methoxycellulose, hydroxyethylcellulose, carboxymethylcellulose, polyvinylpyrrolidone, polyacrylamide, polyacrylic acid, starch and gelatin.

25. A thermosensitive recording material as claimed in claim 21, wherein the water-soluble organic polymers are selected from the group consisting of polyvinyl alcohol, methoxycellulose, hydroxyethylcellulose, carboxymethylcellulose, polyvinylpyrrolidone, polyacrylamide, polyacrylic acid, starch and gelatin.

* * * * *